US008752535B2

(12) United States Patent
Barber et al.

(10) Patent No.: US 8,752,535 B2
(45) Date of Patent: Jun. 17, 2014

(54) DEVICE FOR DECOCKING A CROSSBOW

(75) Inventors: Tim Barber, Honesdale, PA (US); Christopher Knash, Honesdale, PA (US)

(73) Assignee: Archery America, L.L.C., DeQuincy, LA (US)

( * ) Notice: Subject to any disclaimer, the term of this patent is extended or adjusted under 35 U.S.C. 154(b) by 183 days.

(21) Appl. No.: 13/325,953

(22) Filed: Dec. 14, 2011

(65) Prior Publication Data

US 2012/0152220 A1 Jun. 21, 2012

Related U.S. Application Data

(60) Provisional application No. 61/422,770, filed on Dec. 14, 2010, provisional application No. 61/440,563, filed on Feb. 8, 2011, provisional application No. 61/494,500, filed on Jun. 8, 2011.

(51) Int. Cl.
*F41B 5/12* (2006.01)

(52) U.S. Cl.
USPC ..... 124/25

(58) Field of Classification Search
USPC ..... 124/23.1, 25, 25.6, 86
See application file for complete search history.

(56) References Cited

U.S. PATENT DOCUMENTS

| | | | | |
|---|---|---|---|---|
| 3,561,419 | A | 2/1971 | Cucuzza | |
| 4,261,321 | A * | 4/1981 | Nishioka | 124/67 |
| 5,445,139 | A | 8/1995 | Bybee | |
| 5,749,348 | A | 5/1998 | Oviedo-Reyes | |
| 6,273,078 | B1 | 8/2001 | Schwesinger | |
| 6,499,478 | B1 * | 12/2002 | Perez | 124/86 |
| 6,799,566 | B1 | 10/2004 | Malucelli | |
| 7,017,568 | B1 | 3/2006 | Smith | |
| 7,216,643 | B2 * | 5/2007 | Pellerite | 124/86 |

OTHER PUBLICATIONS

Vibracheck—Safedraw Shooting System offered by Archery Exchange (www.archeryexchange.com).

* cited by examiner

*Primary Examiner* — John Ricci
(74) *Attorney, Agent, or Firm* — Schultz & Associates, P.C.

(57) ABSTRACT

A decocking device for use with a crossbow, the device including a resistance system, including a fluid containing cylinder having a movable piston and a shaft extending from the piston, the piston being movable between a first position and a second position, and the cylinder including an orifice having a size and extending through the piston to enable fluid to travel from one side of the piston to the other and to control the movement of the piston to a desired rate; a mounting system including a bracket securable to the crossbow for releasably securing the resistance system to the crossbow; and a bowstring coupling system coupled to the resistance system and including a cable having a first portion releasably securable to the bowstring and a second portion of the cable passing by a fixed location on the shaft of the resistance system.

6 Claims, 7 Drawing Sheets

UNCOCKED CROSSBOW

COCKED CROSSBOW

DEVICE FOR DECOCKING A CROSSBOW

CROSS-REFERENCE TO RELATED APPLICATIONS

This application claims priority to U.S. Provisional Application Ser. No. 61/422,770 filed Dec. 14, 2011, and entitled DECOCKING DEVICE FOR A CROSSBOW, U.S. Provisional Application Ser. No. 61/440,563 filed Feb. 8, 2011, and entitled DECOCKING DEVICE FOR A CROSSBOW, and U.S. Provisional Application Ser. No. 61/494,500 filed Jun. 8, 2011, and entitled DECOCKING DEVICE FOR A CROSSBOW, each incorporated by reference herein in its entirety.

FIELD

The present disclosure relates to devices for decocking a cocked crossbow. More particularly, the disclosure relates to a portable device that can be applied to a cocked crossbow as desired for facilitating decocking of the crossbow without dry firing or firing a projectile.

BACKGROUND

The disclosure relates to a device for the uncocking of a crossbow, also called decocking of a crossbow. More directly, the disclosure relates to uncocking or decocking a ready-to-fire crossbow without dry firing or firing a projectile known in the art as an arrow or sometimes referred to as a bolt, a medieval term for a short arrow.

Crossbows are generally cocked by a manually drawing the bowstring by hand to a loaded position or by using a drawstring or a winch-type cranking mechanism that draws the bowstring that is attached to the bowlimbs of the crossbow into a loaded position where the string is locked by a trigger mechanism. This load also known as potential elastic energy is measured in the art today by draw pounds. Most modern crossbows bear draw weights from 100-200 pounds. Once the release mechanism is actuated by the trigger, the bowstring is released and the potential elastic energy transitions to potential kinetic energy.

Drawing a crossbow string to a cocked position is accomplished in several ways. Most commonly today, crossbows are outfitted with a steel or aluminum stirrup mounted on the front of the crossbow. The stirrup is used to hold the front of the bow down with one foot, while the bowstring is drawn using a drawstring typically comprised of braided nylon or polypropylene rope attached to hooks on each end with a "T" or "D" handle that traverses on the drawstring. By attaching the hooks to the bowstring, then stepping in the stirrup and pulling on the handles in an upward motion, the bowstring of the crossbow is drawn into a loaded cocked position.

Another method of cocking the crossbow is a cranktype mechanism. This mechanism uses a gear reduction manual cranking means as the method to draw the bowstring into the loaded position. Efficient as a cocking device, it is generally not recommended to attempt to uncock or decock the crossbow using this device as it can and may cause serious injury to the operator and potentially damage to the crossbow.

Once the bow is cocked, this stored load of elastic energy can be released transitioning to potential kinetic energy by the actuation of a trigger mechanism releasing the bowstring, which then propels a projectile known as an arrow although sometimes referred to as a bolt, with tremendous thrust and speed, away from the crossbow. This is also the typical manner of uncocking, decocking or unloading a cocked or loaded crossbow, which can result in losing, damaging or destroying the deployed arrow. In some jurisdictions it is illegal to exit a hunting area with a loaded weapon, such as a crossbow, requiring one to discharge the crossbow, propelling the arrow prior to exiting the field, a potentially dangerous and inefficient manner of unloading.

Accordingly, there is a need for device that can be applied to a cocked crossbow as desired for facilitating decocking of the crossbow without dry firing or firing a projectile.

SUMMARY

In one aspect of the disclosure, there is provide a decocking device for use with a crossbow of the type having a stock, a bowstring, and a bowstring catch.

The decocking device includes a resistance system, with a fluid containing cylinder having a movable piston and a shaft extending from the piston, the piston being movable between a first position and a second position, and the cylinder including an orifice having a size and extending through the piston to enable fluid to travel from one side of the piston to the other and to control the movement of the piston to a desired rate; a mounting system including a bracket securable to the stock of the crossbow for releasably securing the resistance system to the stock of the crossbow; and a bowstring coupling system coupled to the resistance system and including a cable having a first portion releasably securable to the bowstring and a second portion of the cable interfacing with a location on the shaft of the resistance system.

The device is operated to decock the crossbow when the crossbow is in a cocked state by mounting the resistance system to the stock of the crossbow using the mounting system, releasably securing the cable to the bowstring, applying pressure to the piston by pulling on the shaft to extend the shaft, then actuating the catch to release the bowstring. The released bowstring applies pressure to retract the shaft, which pressure is resisted by the resistance system, with the size of the orifice controlling the retraction of the shaft and thereby controlling travel of the bowstring and decocking of the crossbow.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein:

FIG. 1 is a perspective view of an uncocked, unloaded crossbow.

DETAILED DESCRIPTION

Figure 7:
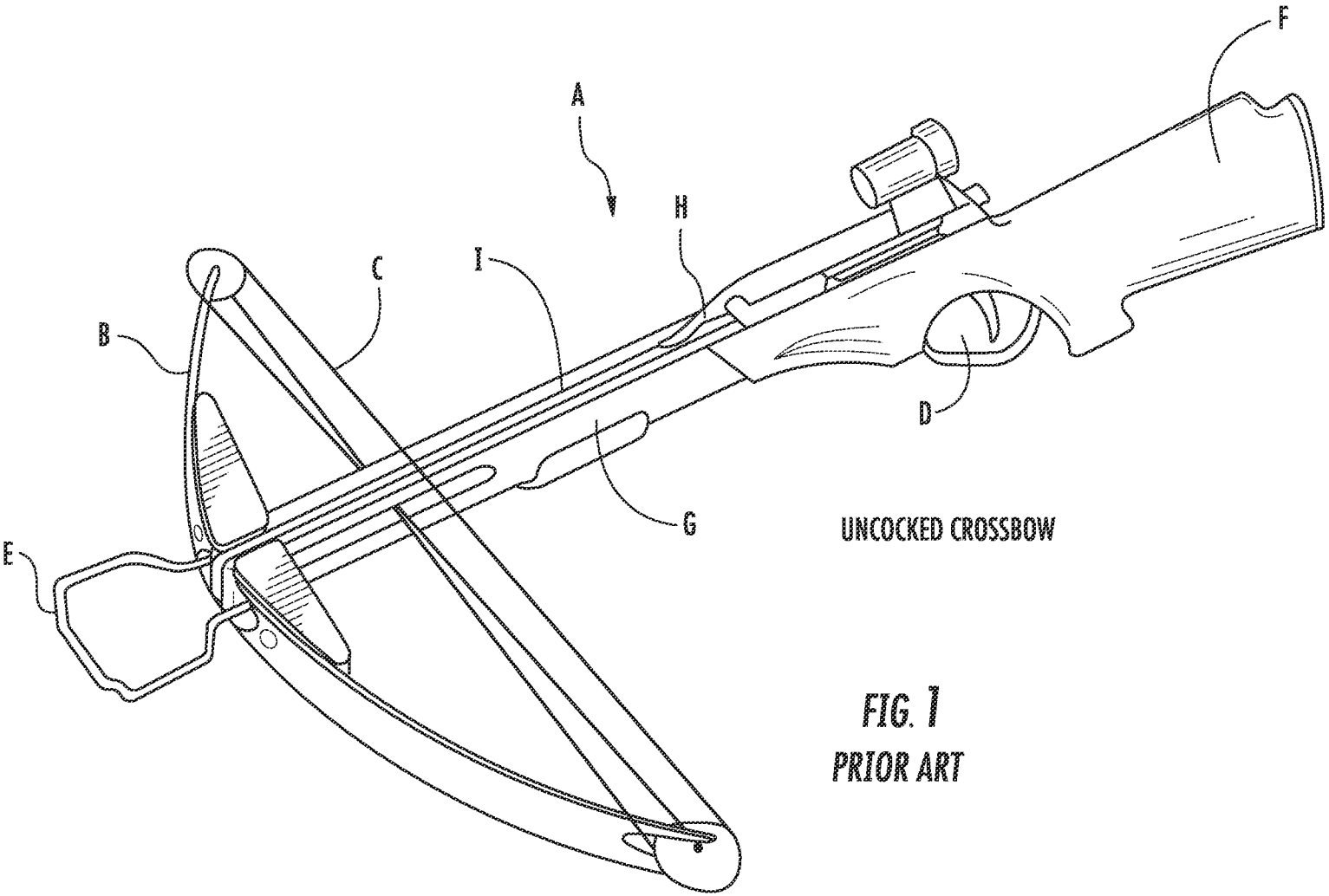
FIG. 7 PRIOR ART
FIGS. 6 and 7 are close-up views of portions of a decocking device according to the disclosure applied to a crossbow.
Figure 2:
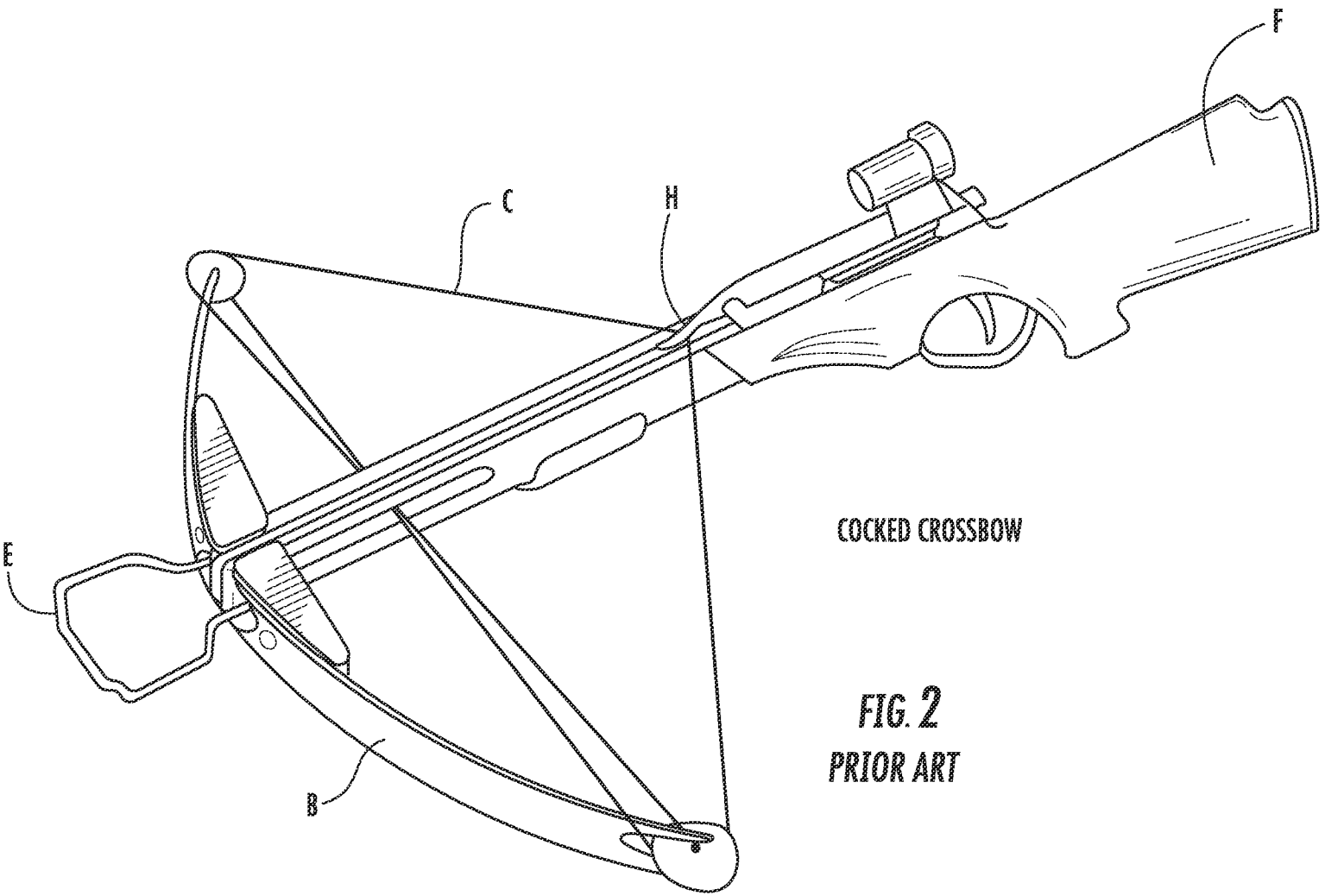
FIG. 2 PRIOR ART
FIG. 2 shows the crossbow of FIG. 1 in a cocked position.
Figure 3:
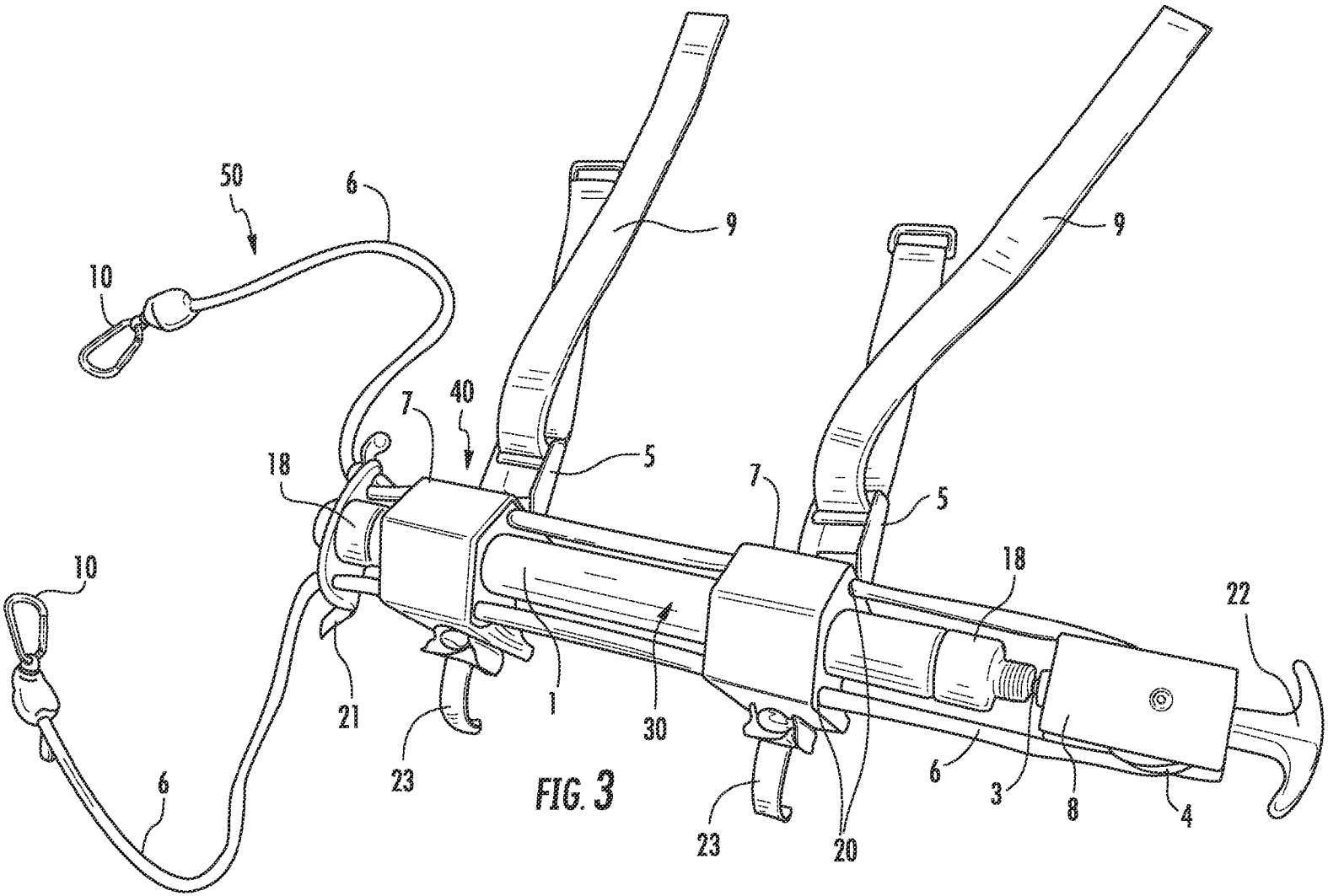
FIG. 3 is an overhead perspective of a device according to the disclosure for application to a cocked crossbow, such as the cocked crossbow of FIG. 2, for decocking thereof.
Figure 4:
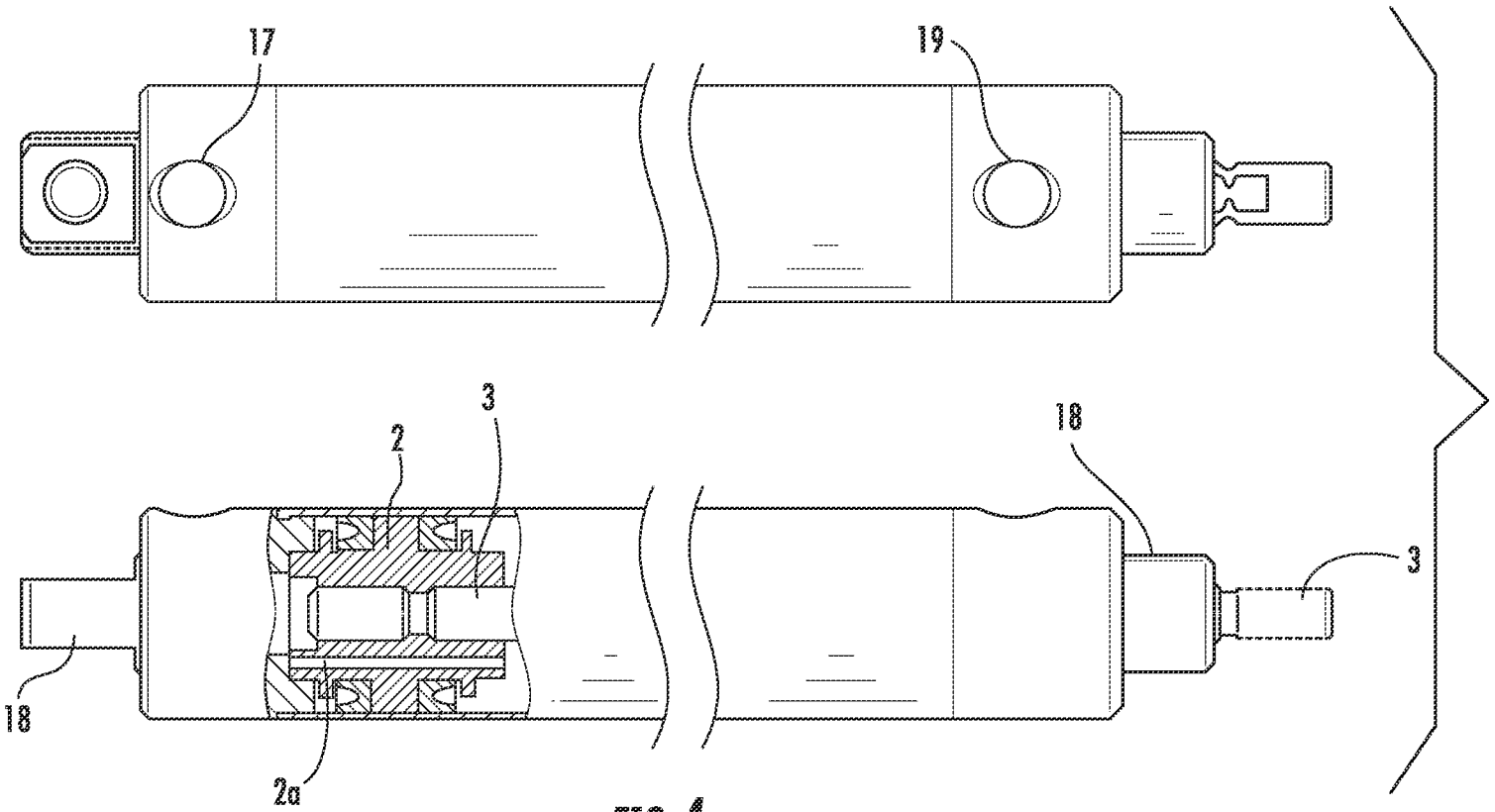
FIG. 4 shows a fluid power cylinder component of the device of FIG. 3.
Figure 5:
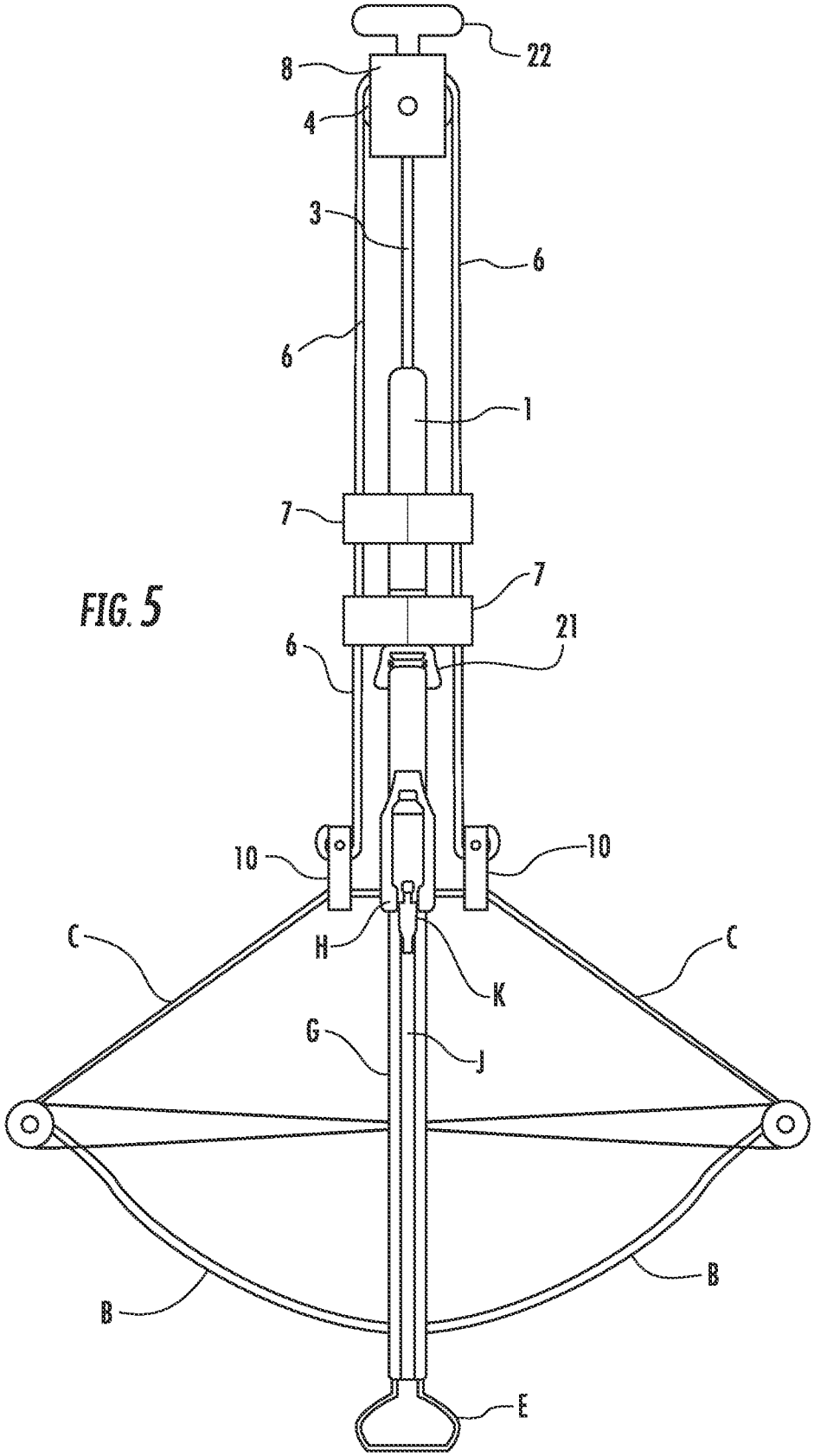
FIG. 5 is an overhead plan view of the decocking device of the disclosure applied to a crossbow.
Figure 6:
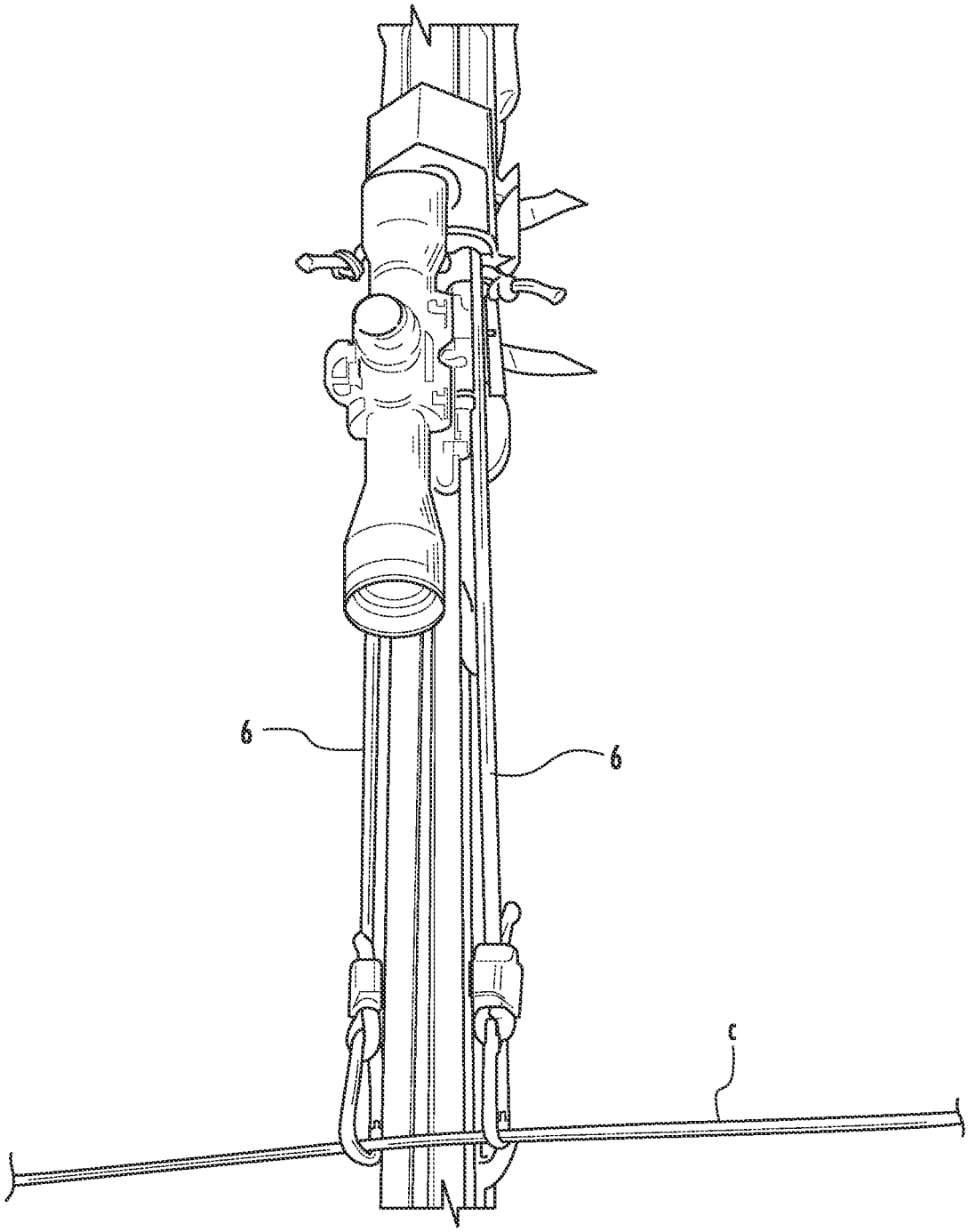
Figure 7:
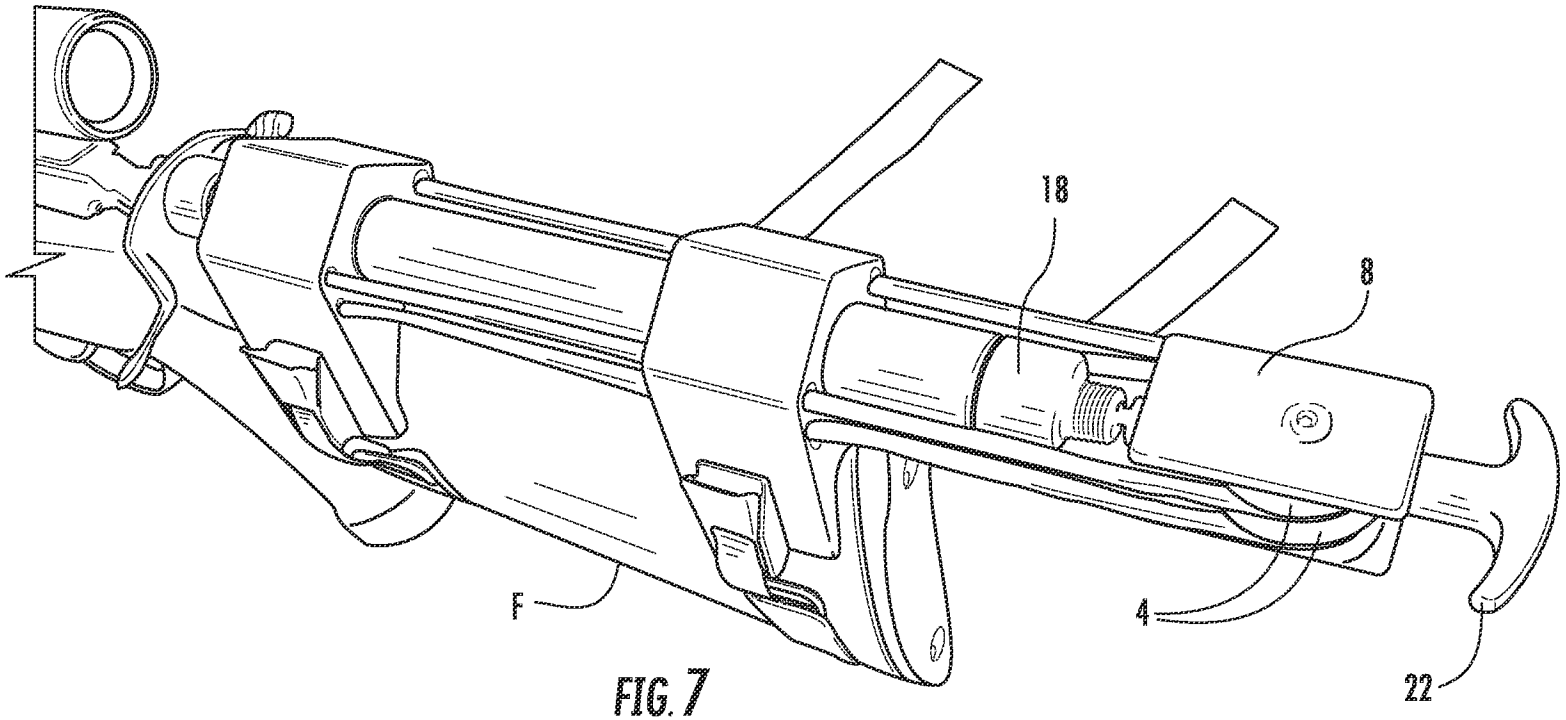

With reference to FIGS. 1 and 2, there is shown a conventional crossbow A having a bow B, bowstring C, trigger D, stirrup E, buttstock F, forestock G, catch H, and arrow groove I. The crossbow A is shown in a relaxed state in FIG. 1 and in a tensioned or drawn state in FIG. 2. In basic operation of crossbows, such as the crossbow A, the bowstring C is drawn back (FIG. 2) and captured by the catch H to maintain the bow B in tension. An arrow or bolt J is oriented in the groove I so that a nock K of the bolt J (see FIG. 5) is maintained in contact with a central portion of the bowstring C retained by the catch H. To fire the crossbow A, a user activates the trigger D, which manipulates the catch H to release the bowstring C and thereby fire the bolt J, and decock the crossbow A.

In accordance with the disclosure, and with reference to FIGS. 3-7, there is provided a decocking device 100 for application to the crossbow A to enable decocking of the crossbow A without dry firing thereof and without firing of a bolt or arrow.

In a preferred embodiment, the decocking device 100 includes a resistance system 30, a mounting system 40, and a bowstring coupling system 50. The resistance system 30 is mounted to the crossbow A by use of the mounting system 40 and supplies a resistance force to enabled controlled return of the crossbow A from the drawn state to the relaxed state. In this regard, the bowstring coupling system couples the bowstring C to the resistance system 30 so as to enable the resistance system 30 to interact with the bowstring C.

The resistance system 30 may include a double-acting fluid cylinder 1. In this regard, the term "fluid" will be understood to encompass both liquid and gas cylinders. A preferred fluid cylinder is a pneumatic cylinder having an internal piston 2 from which extends in one direction a shaft 3. A through-bored orifice 2*a* extends through the piston to permit gas/air (or other fluid) to travel from one side of the piston 2 to the other side, it being understood that the size of the orifice 2*a* controls passage of fluid and, hence, travel of the piston 2 and the shaft 3 connected to the piston 2. A desired dimension of the orifice 2*a* is 0.062 inches. The cylinder 1 includes an endcap 18 at each end of the cylinder 1, with the shaft 3 extending outwardly through one of the endcaps 18. The cylinder also includes a pair of ports 17 and 19 located at opposite ends of the cylinder 1 for introduction of fluid (air for a pneumatic cylinder) into the cylinder. Double acting pneumatic cylinders utilize air pressure to control movement in both the extending and retracting strokes, i.e., extension of the shaft out of the cylinder and retraction into the cylinder. In this regard, as will be explained more fully below, manual pressure is provided by pulling on a handle 22 coupled to the end of the shaft 3 to extend the shaft 3 and, when the bowstring C is released, the bowstring C applies pressure to retract the shaft 3, with the size of the orifice 2*a* controlling the retraction of the shaft 3 and thereby controlling de-tensioning of the crossbow A.

The mounting system 40 includes cambuckles 5, mounting brackets 7, straps 9, and latches 23. A Y or other shaped stabilizer 21 is also desirably mounted to the cylinder 1 and to cradle an adjacent section of the buttstock F when the resistance system 30 is mounted to the buttstock F using the mounting system 40. The mounting brackets 7 are configured to fittingly receive the cylinder 1 and to be releasably mounted onto the buttstock F to desirably mount the resistance system 30 to an upper portion of the buttstock F of the crossbow A. The cambuckles 5, straps 9, and latches 23 are utilized to releasably mount the mounting brackets 7 onto the buttstock F. However, it will be understood that other mounting structures may be utilized to mount the resistance system 30 to the crossbow A.

The coupling system 50 couples the resistance system 30 to the bowstring C and includes a pair of pulleys 4 rotatably located on bracket 8, and a pair of cable cords or decocking cables 6, one trained around each of the pulleys 4. One free end of each of the cables 6 is secured to the stabilizer 21, and the other free end of each of the cables 6 includes a hook 10 or other connecting structure for releasably connecting the end of the cable 6 to the bowstring C. Thus, each of the cables 6 is connectable to the bowstring C. While a single cable could be utilized, it is preferred to utilize at least two for redundancy. The bracket 8 having the pulley 4 is secured on the shaft 3 adjacent the handle 22 and travels with the shaft 3. The mounting brackets 7 and the stabilizer 21 also preferably include apertures or the like for slidably routing the cables 6.

To utilize the decocking device 100, the cylinder 1 is filled with fluid through the ports 17 and 19, and is mounted to the buttstock C using the mounting system 40. For example, the device 100 may be positioned over the topside of the buttstock with the stabilizer 21 positioned along each side of the buttstock. The straps 9 are then positioned around the buttstock and the device 100 secured in place by tightening the straps 9 using the latches 23 and the cambuckles.

Next, the cables 6 are attached to the bowstring by use of the hooks 10 on either side of the catch H near the trigger D of the crossbow. The cables 6 are desirably routed through guide holes located on the mounting brackets 7 and around the pulleys 4 located on the shaft 3 of the cylinder 1. The shaft 3 is then manually extended by pulling the handle 22 until the cables 6 are taught and shaft 3 is fully extended. Next, the trigger D of the crossbow is actuated to release the bowstring from the catch. The force supplied by the bow via the bowstring acts via the cables 6 to urge the piston 2 and the shaft 3 to the retracted position in the cylinder 1. This movement of the piston 2 piston forces fluid through the orifice 2*a*, moving the fluid from the front of the piston to behind the piston within the cylinder 1. The small orifice size regulates the fluid volume at a specific flow rate, permitting the piston 2 to move through the cylinder 1 at a slow regulated pace, thus allowing the crossbow to decock under a controlled state. By doing so, the bowstring which is attached to the bow, moves slowly from a tensioned position to a neutral uncocked position.

Accordingly, it will be appreciated that structures according to the disclosure are suitably configured for use with a crossbow to enable the bowstring to be positioned from a cocked, ready-to-fire position, to an uncocked and at-rest position without firing a projectile or without dry firing the crossbow.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated.

The invention claimed is:

1. A decocking device for use with a crossbow of the type having a stock, a bowstring, and a bowstring catch, the decocking device, comprising:

a resistance system, including a fluid containing cylinder having a movable piston and a shaft extending from the piston, the piston being movable between a first position and a second position, and the cylinder including an orifice having a size and extending through the piston to enable fluid to travel from one side of the piston to the other and to control the movement of the piston to a desired rate;

a mounting system including a bracket securable to the stock of the crossbow for releasably securing the resistance system to the stock of the crossbow; and a bowstring coupling system coupled to the resistance system and including a cable having a first portion releasably securable to the bowstring and a second portion of the cable interfacing with a location on the shaft of the resistance system;

wherein the device is operated to decock the crossbow when the crossbow is in a cocked state by mounting the resistance system to the stock of the crossbow using the mounting system, releasably securing the cable to the bowstring, applying pressure to the piston by pulling on the shaft to extend the shaft, then actuating the catch to release the bowstring, wherein the released bowstring applies pressure to retract the shaft, which pressure is resisted by the resistance system, with the size of the orifice controlling the retraction of the shaft and thereby controlling travel of the bowstring and decocking of the crossbow.

2. The device of claim 1, wherein the bowstring coupling system comprises a pair of cables and a pair of pulleys mounted to the shaft of the resistance system for travel with the shaft, wherein each of the cables extends around one of the pulleys and one end of each of the cables is fixed in position relative to a non-moving portion of the device and the other end is releasably securable to the bowstring.

3. The device of claim 1, wherein the fluid is a gas.

4. The device of claim 1, wherein the cylinder is a double-acting cylinder.

5. The device of claim 1, further comprising a handle secured to the shaft and graspable by a user for applying manual pressure to the piston by pulling on the handle to extend the shaft.

6. A method for decocking a crossbow, comprising the steps of:

supplying a cocked crossbow having a bowstring and a catch securing the bowstring in a tensioned state;

releasably mounting a decocking device on the crossbow, the docking device comprising: a resistance system, including a fluid containing cylinder having a movable piston and a shaft extending from the piston, the piston being movable between a first position and a second position, and the cylinder including an orifice having a size and extending through the piston to enable fluid to travel from one side of the piston to the other and to control the movement of the piston to a desired rate, and a bowstring coupling system coupled to the resistance system and including a cable having a first portion releasably securable to the bowstring and a second portion of the cable passing by a fixed location on the shaft of the resistance system;

operating the decocking device to decock the crossbow, such operation comprising releasably securing the cable to the bowstring, applying manual pressure to the piston by pulling on the shaft to extend the shaft, then actuating the catch to release the bowstring, wherein the released bowstring applies pressure to retract the shaft; and removing the decocking device from the crossbow.

* * * * *